US008226431B2

(12) United States Patent
Reimchen

(10) Patent No.: US 8,226,431 B2
(45) Date of Patent: Jul. 24, 2012

(54) CABLE CONNECTOR WITH PIVOTING HOOKS TO CLAMP CABLE STRANDS

(75) Inventor: Valeri Reimchen, Steinheim/Sandebeck (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/047,364

(22) Filed: Mar. 14, 2011

(65) Prior Publication Data

US 2011/0223796 A1 Sep. 15, 2011

(30) Foreign Application Priority Data

Mar. 12, 2010 (DE) ..... 10 2010 011 370

(51) Int. Cl.
*H01R 13/58* (2006.01)

(52) U.S. Cl. ..... 439/459

(58) Field of Classification Search ..... 439/457–460
See application file for complete search history.

(56) References Cited

U.S. PATENT DOCUMENTS

| | | | | |
|---|---|---|---|---|
| 3,951,501 | A * | 4/1976 | Bauerle et al. | 439/341 |
| 4,526,428 | A * | 7/1985 | Sachs | 439/92 |
| 4,874,332 | A * | 10/1989 | Munroe | 439/462 |
| 4,960,388 | A * | 10/1990 | Frantz et al. | 439/404 |
| 7,488,196 | B2 * | 2/2009 | Kocher et al. | 439/457 |
| 7,722,382 | B2 * | 5/2010 | Landis et al. | 439/393 |
| 2008/0108246 | A1 * | 5/2008 | Landis et al. | 439/464 |

FOREIGN PATENT DOCUMENTS

DE 4418259 C1 8/1995

* cited by examiner

*Primary Examiner* — Chandrika Prasad
(74) *Attorney, Agent, or Firm* — Scully, Scott, Murphy & Presser, P.C.

(57) ABSTRACT

A cable connector, in particular a multipolar cable connector, for connecting a multi-core stranded cable is provided. The connector has a plug part which has several contact elements formed as contact bars. The connector further has a cable uptake which has a strand support element for receiving the strands of the multi-core stranded cable. The strand support element has pivotally mounted hook elements, which clamp and affix the strands introduced into the strand support element between the hook elements pivoted in the direction of the strands and an interior wall of the strand support element by means of a pivot movement in an assembled condition.

11 Claims, 9 Drawing Sheets

CABLE CONNECTOR WITH PIVOTING HOOKS TO CLAMP CABLE STRANDS

BACKGROUND

The invention concerns a cable connector, in particular a multipolar, cable connector, for connecting a multi-core stranded cable.

A cable connector consisting of a distribution piece for receiving individual strands of a stranded cable, a cable uptake assembled from a handle and a cable gland with pressure screw, and a plug part formed from a contact support with contact bars located in contact chambers and a screw cap for fitting the cable uptake to the distribution piece is known from DE 44 18 259 C1. The cross-section of the cable side end part of the distribution piece is formed as an octagon, whereby the eight straight sleeve surfaces are conically tapered in the direction of the free end. The shape of the inner contour of the plug side section of the handle is matched to suit the outer contour of the cable side end part of the distribution piece. The distribution piece is penetrated by four axially parallel channels for receiving non-stripped stranded conductors, whereby the partitions of each two channels as well as the opposing exterior walls between the channels and the respective sleeve surfaces comprise slots, with which two sprung exterior parts are formed. The diameter of the channels is a little smaller than the external diameter of the individual strands, so that a slight clamping of the strands within the clamping area of the distribution parts is realised with the aid of insertion funnels and the sprung exterior parts, so that the target position of the strands can be assured. During a further step the distribution piece is pressed into the handle, whereby a radial force component is created by the cooperating conical surfaces, which is to ensure the necessary clamping of the strands within the clamping area. With such a design of a cable connector only a relatively small clamping effect can however be applied to the individual strands in the distribution piece, so that the risk of pushing back the strands with the contact elements designed as contact bars is relatively great during the contacting process, so that a secure contacting of individual strands of the stranded cable cannot be guaranteed.

It is therefore the purpose of the invention to provide a cable connector, in particular a multipolar, cable connector, with which an improved clamping effect can be realised for the strands introduced into the cable connector to be able to guarantee secure contacting.

SUMMARY

The cable connector of the invention, in particular the multipolar, cable connector, for connecting a multi-core stranded cable comprises a plug part, which comprises several contact elements designed as contact bars, and a cable uptake comprising a strand support element for receiving the strands of the multi-core stranded cable, whereby the strand support element comprises pivotally mounted hook elements, which clamp and affix the strands introduced into the strand support element between the hook elements pivoted in the direction of the strands and an interior wall of the strand support element by means of a pivot movement in the assembled condition.

The cable connector of the invention is characterised in that additional hook elements are envisaged on the strand support element as a safeguard against an undesired axial displacement of the strands along their longitudinal axis within the strand support element, in particular during contacting with the contact elements designed as contact bars, which can affix the strands in desired position by means of a pivot movement of the hook elements to be able to guarantee a secure contacting of the strands with the contact elements. When inserting the strands into the strand support element the hook elements are preferably pivoted in such a way that the same will not obstruct the insertion of the strands, and are therefore not located in or do not protrude into the area of the input opening of the strand support element for introducing the strands into the strand support element. Only when the strands have been positioned in the desired position in the strand support element will the hook elements be pivoted in the direction of the strands positioned in the strand support element for transferring the same into an assembled condition in such a way that the hook elements touch the external circumference surface of the strands and press these against an internal wall of the strand support element, and thus clamp and affix the same between the hook elements and the internal wall of the strand support element. The pivot movement of the hook elements is preferably realised in that a sleeve is pushed over the exterior circumference surface of the strand support element and the hook elements are moved, preferably pressed, by the sleeve, in particular an internal surface of the sleeve, in the direction of the interior area of the strand support element, where the introduced strands are located. In this clamped fixed position a movement of the strands in an axial direction along their longitudinal axis is no longer possible. A pushing back of the strands against the input direction of the strands into the strand support element during the contacting process of the strands with the contact elements can therefore be prevented. The hook elements can apply a permanent contact pressure onto the strands in a radial direction in the assembled condition, in which the hook elements abut against the external circumference surface of the strands, in order to realise a secure affixing of the strands. The pivotable arrangement of the hook elements on the strand support element enables a simple, unobstructed insertion of the strands into the strand support element as well as a subsequent secure clamping of the strands by means of the hook elements. The strands can, as soon as they are clamped and affixed by means of the hook elements, be contacted axially along their longitudinal axis by the contact elements designed as contact bars in that the plug part is connected with the cable uptake. A defined radial pressure can be applied to the inserted strands by means of the pivotally mounted hook elements. In this way a secure affixing of the strands during contacting can be guaranteed.

According to a preferred embodiment of the invention the hook elements are designed in such a way that two strands can be clamped and affixed simultaneously by means of a hook element. For this the hook elements are preferably designed in such a way that they are sufficiently wide to extend across the external diameter of two strands with their width. The number of necessary construction elements, in particular the hook elements, for affixing the strands in the strand support elements can thus be reduced. The most uniform simultaneous clamping of several strands can also be guaranteed in that a constant pressure can simultaneously be applied to several strands by one hook element each.

It is further preferably envisaged that the hook elements are of a wedge shaped design. With this wedge shaped design the hook elements can be hooked up along the external circumference surface of the strands particularly effectively, and these clamped and affixed in this way. The wedge shaped design is preferably envisaged in the area of the hook element, which forms a free end of the hook elements that is not located directly on the strand support element itself. The wedge shaped hook elements can comprise a tip that is pressed into the insulation of the strands and can thus achieve a particularly secure affixing of the strands in the desired position against an axial displacement along their longitudinal axis.

The strand support element further preferably comprises guide elements for guiding the strands along the internal circumference surface of the guide elements, whereby the internal circumference surfaces of the guide elements can be pressed against the external diameter of the strands inserted into the strand support element. The guide elements each comprise preferably one through bore designed as an internal circumference surface, through which the strands can be passed during positioning on the cable uptake. The guide elements are preferably located separate from the hook elements on the strand support element. Prior to inserting the strands into the guide elements or into the through bore of the guide elements the guide elements comprise an internal circumference surface in the area of the through bore, which can be adjusted to suit the external diameter of the strands to be inserted. For this the internal circumference surface or the through bore preferably comprises a diameter that is smaller than the external diameter of the strands at least in some areas, whereby the guide elements are designed in such a way that the guide elements can expand when the strands are inserted along their internal circumference surface, so that the diameter of the internal circumference surface can enlarge to equal the external diameter of the inserted strands. In this way it is possible to realise a slight clamping of the strands as soon as the strands are inserted into the guide elements. For this the guide elements can preferably expand their internal circumference surfaces in such a way that they can just receive the strands, so that the diameter of the internal circumference surface substantially equals the external diameter of the inserted strands in the inserted condition of the strands.

The guide elements are preferably designed in such a way that the same can apply a radial spring force to the strands in the area of a contact point, in which the contact elements are inserted into the strands in a contacting condition. The spring force radially applied to the contact point enables a particularly secure contact between the strands and the contact elements, whereby it is made particularly sure that a loosening of the contact, for example through the terminal strip slipping off the strands, is effectively prevented.

The internal circumference surface of the guide elements can be matched to the diameter of the inserted strands preferably in such a way that the guide elements comprise a slit-shaped opening along their longitudinal surface. The slit-shaped opening preferably does not extend across the entire longitudinal surface of the guide elements, but is formed only in one or more sections of the longitudinal surface of the guide elements. Thanks to the slit-shaped opening, the guide elements can expand in the area of this slit-shaped opening when the strands are inserted into the through bore of the guide elements in such a way that it is just possible to push the strands through the guide elements or through the through bore of the guide elements. This enables an optimal and individual adjustment of the diameter of the internal circumference surface to match the external diameter of the strands to be inserted.

It is further preferably envisaged that the guide elements comprise an end section that is wedge shaped. The wedge shaped end section is preferably the end section that is located opposite the end section via which the strands are inserted into the guide element. The area of the guide element that is not wedge shaped is preferably cylinder shaped. Thanks to the conically shaped design of one end section a slight clamping of the strands inserted into the guide element can already be realised. The slit-shaped opening is preferably envisaged in the area of the conically shaped end section, so that the clamping realised by the conically shaped design of the end section, in particular the radial clamping force acting upon the external circumference surface of the inserted strands, can be optimally adjusted to suit the strands to be inserted.

It is preferably further envisaged that the strand support element comprises an annular surface and one or more base plate elements formed on the annular surface, whereby the hook elements are envisaged on the annular surface and the guide elements on the base plate elements. The fact that the hook elements are located on the annular surface and the guide elements on the base plate elements means that a separation of the function of the guide elements from the hook elements is possible, so that the function of the hook elements is preferably not influenced by the function of the guide elements and vice versa. For this the hook elements are preferably pivotally mounted on the annular surface of the strand support element.

It is preferably envisaged that two guide elements each are envisaged on one base plate. One base plate is preferably designed in such a way that it can receive two guide elements, so that two strands of a stranded cable can be received via one base plate. The fact that two guide elements each are preferably located on one base plate enables a separation of the strands from each other, so that influences in the form of crosstalk can be prevented amongst the same.

It is further preferably envisaged that a groove-shaped opening for receiving a shield element is envisaged between two base plates. The shield element is preferably formed on the plug part and can be inserted into the groove-shaped opening between two base plates when the plug part is assembled with the cable uptake. The shield plate can prevent an influencing of the two respective strands located on a base plate element. A shield element can for example be designed as a shield plate.

BRIEF DESCRIPTION OF THE DRAWINGS

The invention will now be described in more detail with reference to the enclosed drawings and a preferred embodiment.

Shown are in.

DETAILED DESCRIPTION OF EXEMPLARY EMBODIMENTS

Figure 1:
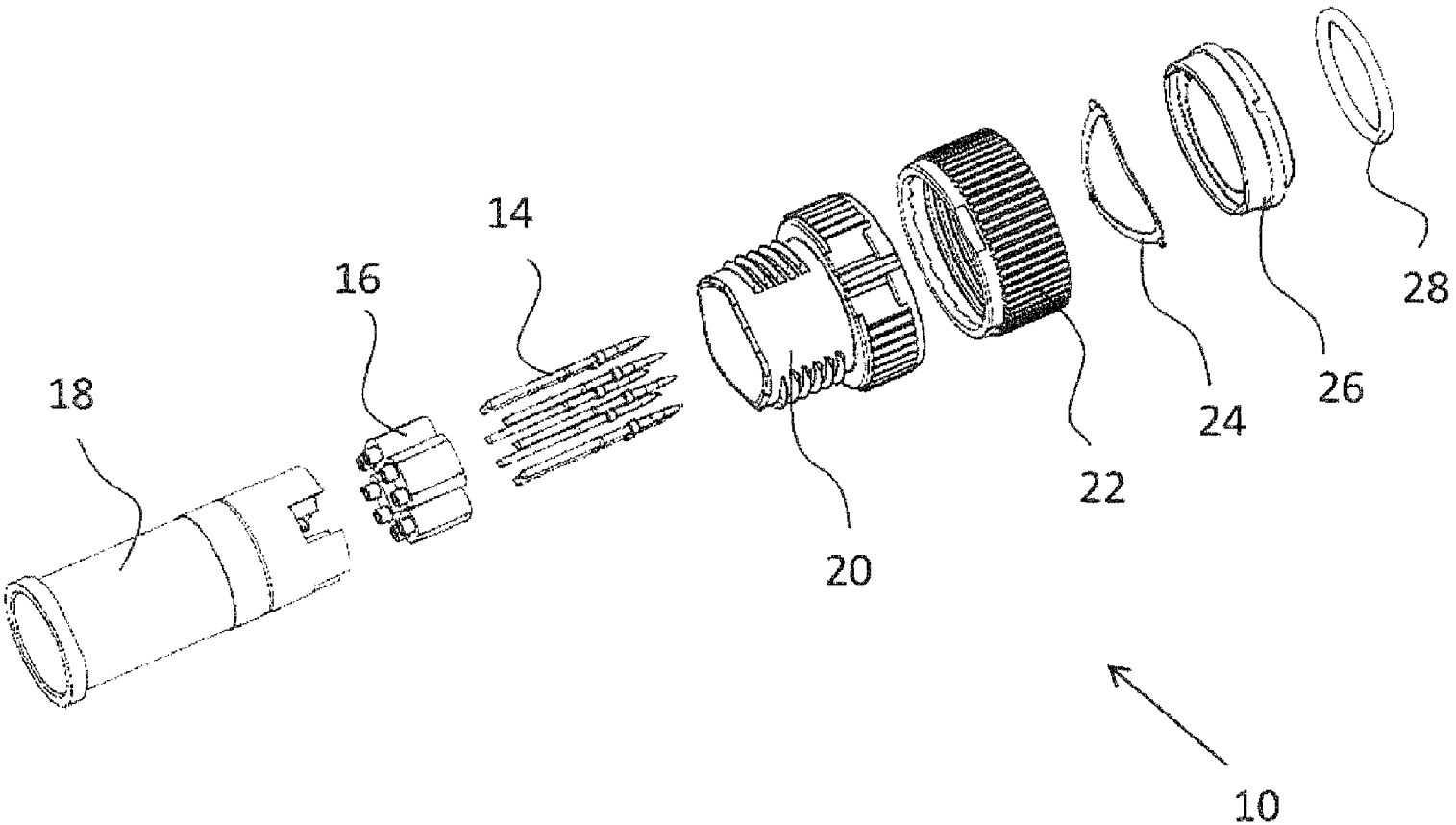
FIG. 1 an exploded illustration of a plug part for a cable connector according to the invention.
Figure 2:
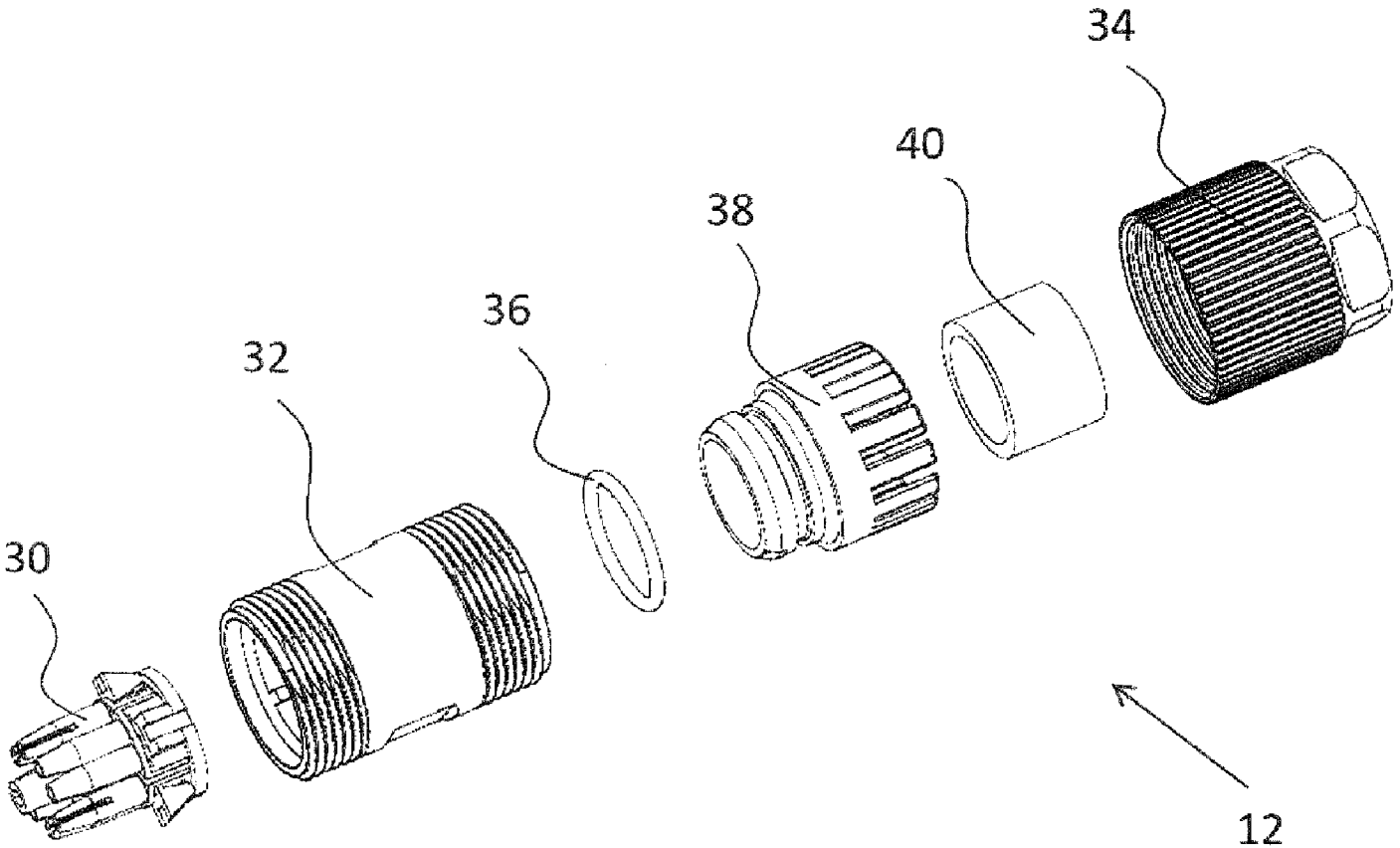
FIG. 2 an exploded illustration of a cable uptake for a cable connector according to the invention.

FIG. 1 shows an exploded illustration of a plug part 10 of the invention, which can be connected with a cable uptake 12 as shown in FIG. 2 for forming a cable connector according to the invention.

As shown in FIG. 1 the plug part 10 comprises several contact elements 14 designed as contact bars, with which strands of a multi-core stranded cable, not shown in FIG. 1, located in the cable uptake 12 can be contacted. The contact elements 14 can be pushed into a contact support element 16 made from a non-conductive material for positioning the contact elements 14 in the plug part 10, which can then in turn be arranged in a sleeve 18 together with the contact elements 14. A screw element 20 with a knurl 22 affixable to the same can then be pushed onto the sleeve 18 for connecting the plug part 10 with the cable uptake 12. A spring 24, a clamping ring 26 and a sealing element 28, for example in the form of an O-ring, can be formed on the knurl 22 for a secure connection of the plug part 10 with the cable uptake 12.

The cable uptake 12 shown in FIG. 2 comprises a strand support element 30 for receiving the strands of a strand cable not shown in FIG. 2. Following receipt of the strands the strand support element 30 can be pushed into a sleeve 32, onto the external circumference surface of which a nut 34, which can comprise a sealing element 36 formed as an O-ring, a crown 38 and a sealing sleeve 40, can be screwed for affixing the cable uptake 12.

Figure 3:
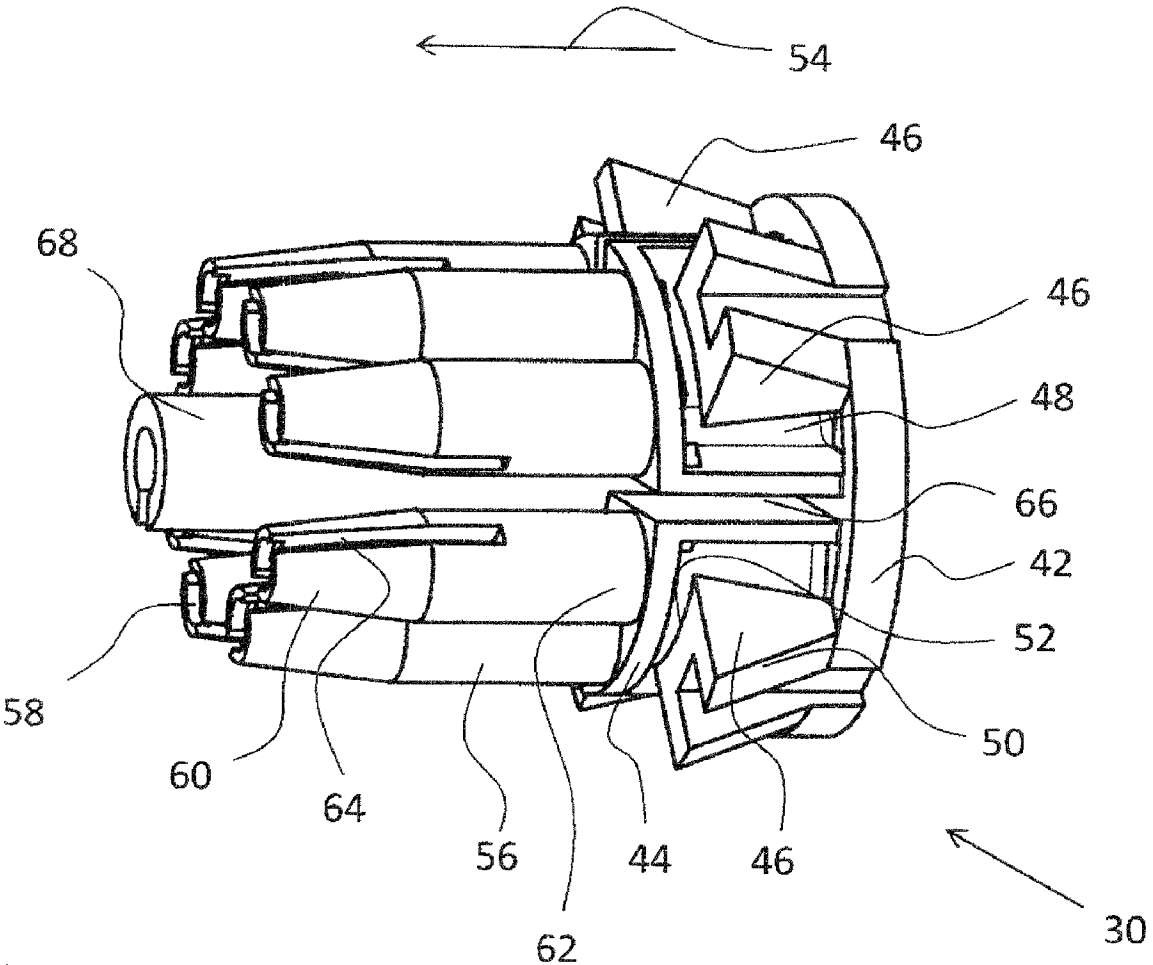
FIG. 3 a schematic connection of a strand support element according to the invention.

An enlarged strand support element 30 is shown in FIG. 3. The strand support element 30 is preferably made from a non-conductive material, preferably a plastic material, and comprises an annular surface 42 and several base plate elements 44 located on the annular surface 42.

Several hook elements 46 are pivotally mounted on the annular surface 42, which can clamp and affix the strands, not shown here, inserted into the strand support element 30 between the hook elements 46 pivoted in the direction of the strands and an interior wall 48 of the strand support element 30, preferably an interior wall 48 of the base plate elements 44, by means of a pivot movement in an assembled condition.

The hook elements 46 are preferably wedge shaped, whereby the hook elements 46 comprise a surface 50 formed at an angle to the longitudinal surface of the strand support element 30, over which the hook elements 46 radially projecting from the annular surface 42 can be pivoted towards the inside and the internal surface of the strand support element 30 by pushing the sleeve 32 over the strand support element 30 in that the sleeve 32 slides over the angled surfaces 50 of the hook elements 46 and thus applies a radial inward force onto the hook elements 46 and can press the same in the direction of the interior wall 48 of the strand support element 30 in this way. The hook elements 46 are designed in such a way here that one hook element 46 each can simultaneously clamp and affix two strands. For this the hook elements 46 are arced along the abutment surface 52 of the hook elements 46 at the inserted strands in line with the strand arrangement in the strand support element 30.

Guide elements 56 for guiding the strands to be contacted are envisaged on the base plate elements 44 above the hook elements 46 viewed in the insertion direction 54 of the strands into the strand support element 30. The guide elements 50 each comprise a through bore 58, through which the strands can be guided. The guide elements 56 are preferably substantially cylindrical, whereby the same comprise a conically shaped end section 60. The conically shaped end section 60 lies opposite the end section 62 over which the guide elements 56 are located on the base plate elements 44. The guide elements 56 comprise a slit-shaped opening 64 in the area of the conically shaped end section 60, which extends along the facing surface of the end section 60 and the longitudinal surface of the guide element 56. The slit-shaped opening 64 is formed in one guide element 56 each in such a way that the guide element 56 can be split into two independently moveable side sections and expand through the slit-shaped opening 64, so that the through bore 58 can expand.

As is clear from FIG. 3 two guide elements 56 each are located on one base plate element 44 in such a way that the strands affixed by one hook element 46 are guided parallel to each other through two guide elements 56 located on one base plate element 44. The slit-shaped opening 64 of the two guide elements 56 located on one base plate element 44 are arranged one behind the other on the same level, so that a uniform expansion of the two guide elements 56 located parallel to each other on one base plate element 44 can be realised.

Figure 8:
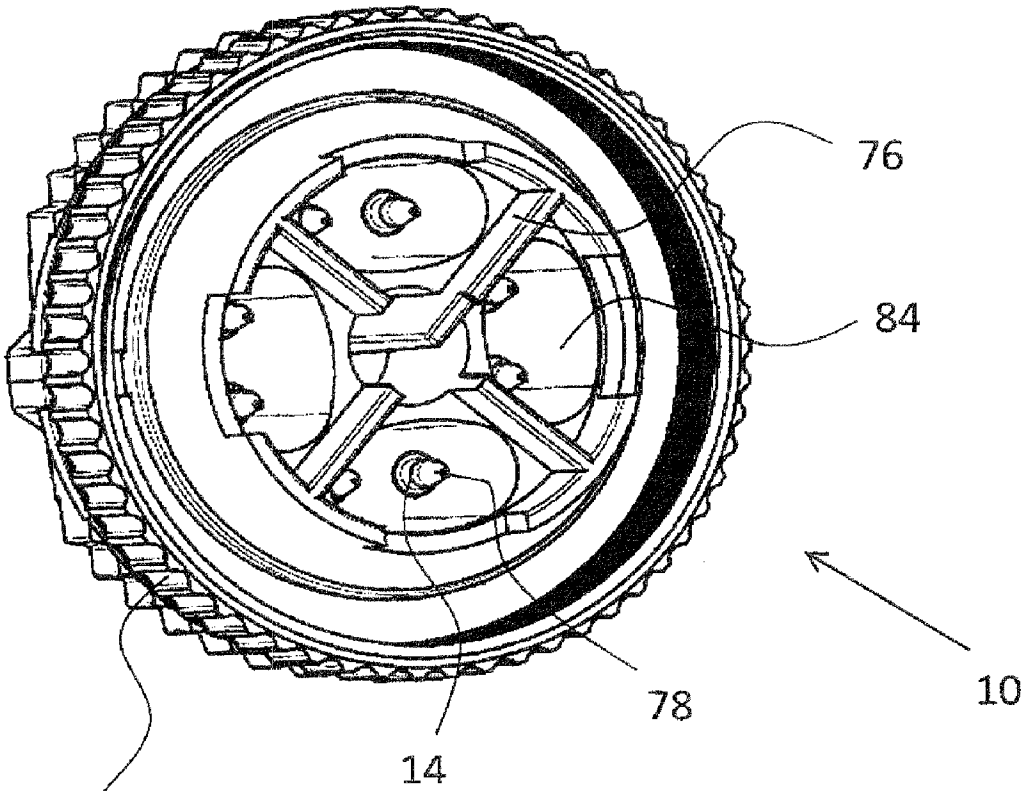
FIG. 8 a schematic illustration of a facing side of the plug part of the cable connector of the invention.

One groove-shaped opening 66 each, which can be engaged by shield elements 76 at the plug part 10 as shown in FIG. 8, is formed between two base plate elements 44.

An encoding dome 68 is further formed along the central axis of the strand support element 30, whereby the guide elements 56 are positioned substantially circular around the encoding dome 68.

Figure 4:
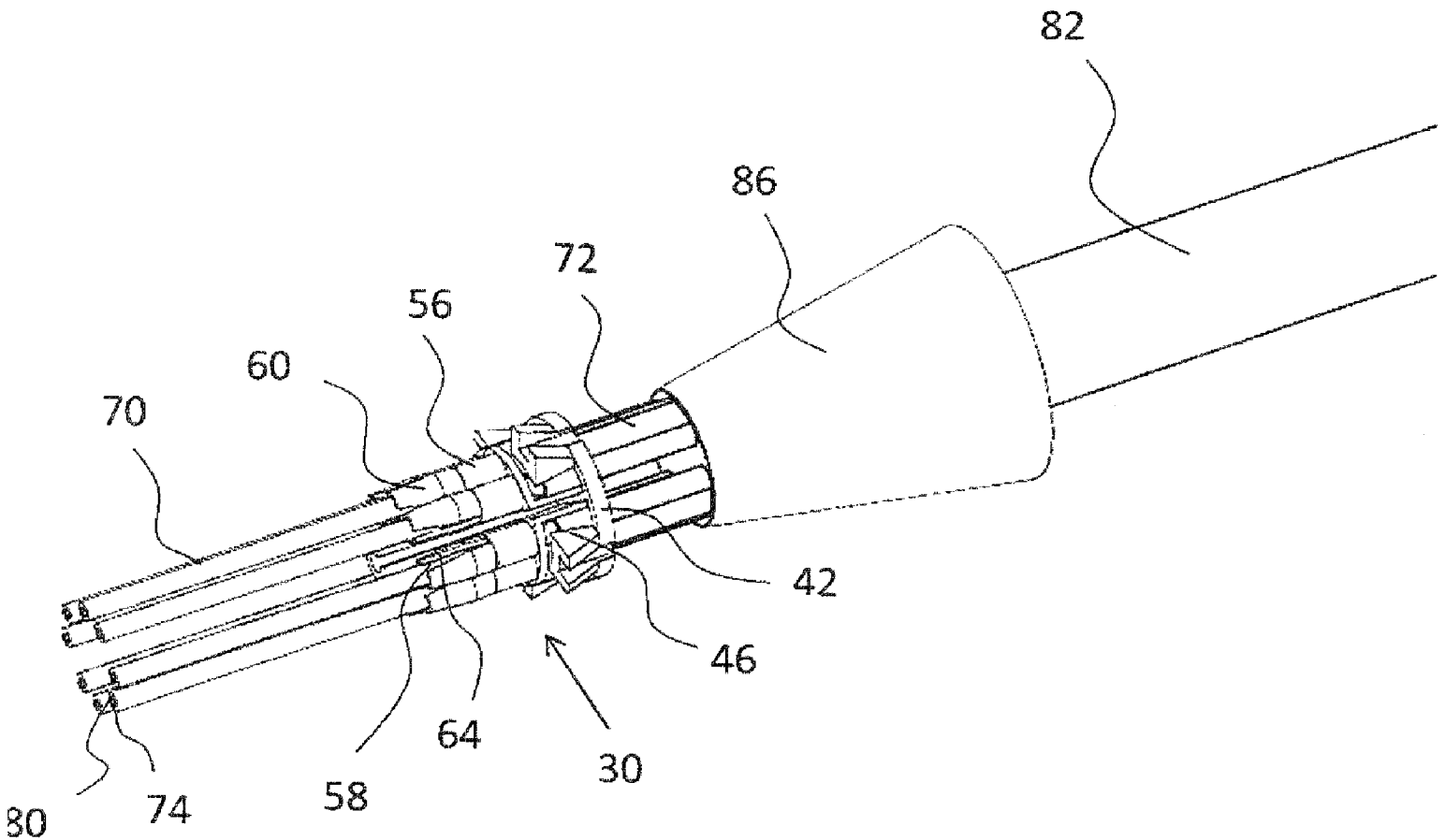
FIG. 4 a schematic illustration of the strand support element shown in FIG. 3 with strands inserted into the same.

FIG. 4 shows the strand support element 30 shown in FIG. 3 with the strands 70 of a stranded cable 82 inserted into the same. The stranded cable 82 comprises two strands 70 guided parallel to each other, each comprising a common casing 72. The casing 72 partially reaches as far as into the strand support element 30. From the area of the strands 70, where the strands 70 can be clamped and affixed by means of the hook elements 46, the casing 72 is removed from the strands 70. Each individual strand 70 however also comprises its own insulation 74, which encases the core 80 of the respective strand 70.

In the illustration shown in FIG. 4 the individual strands 70 have been guided through the through bores 58 of the guide elements 56 of the strand support element 30, whereby it is clear here that the guide elements 56 have been expanded through the slit-shaped opening 64 in the area of the conically shaped end section 60, so that the diameter of the through bore 58 or the interior circumference surface of the guide element 56 can be optimally adjusted to suit the external diameter of the inserted strands 70 to already realise a slight clamping of the strands 70 in the guide elements 56, as the diameter of the through bore 58 preferably equals the external diameter of the strands 70 in this condition. In the condition shown in FIG. 4 a clamping and affixing of the strands 70 by means of the hook elements 46 does not yet take place. The strands 70 have also been pushed as far as required into the strand support element 30, so that the same project further than the guide elements 56.

Figure 6:
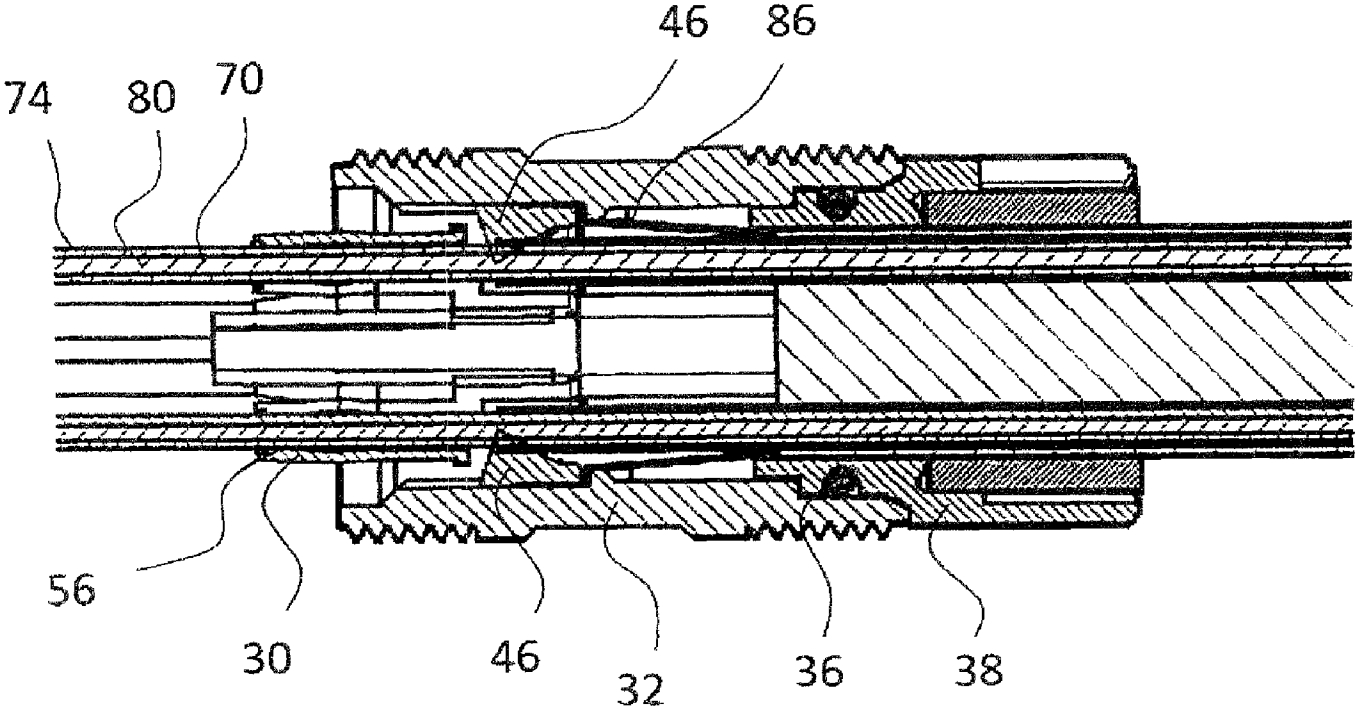
FIG. 6 a schematic cross-sectional illustration of the arrangement of the cable connector shown in FIG. 5.

As is clear from FIG. 4 a shielding braid 86 is affixed to the cable 82, the same being turned upside down starting from the position shown in FIG. 4, as shown in FIG. 6, so that the shielding braid 86 is laid forward over the strand support element 30 and is subsequently cut off with and overlapping the annular surface 42 of the strand support element 30. In the assembled condition as shown in FIG. 6 the shielding braid 86 is pressed against the sleeve 32 with the annular space 42, so that a 360° shielding connection is created by means of the shielding braid 86.

Figure 5:
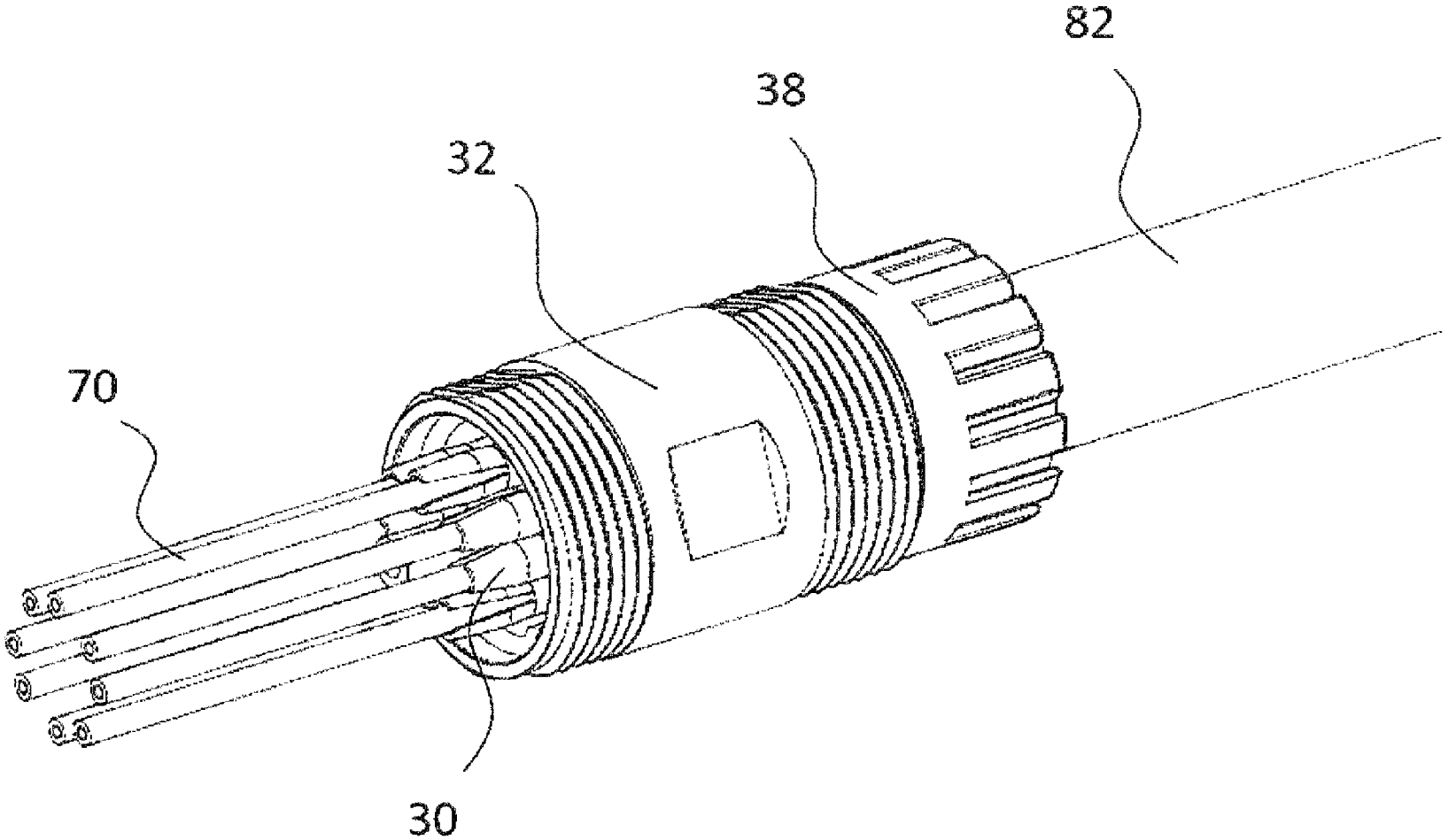
FIG. 5 a schematic illustration of the strand support element shown in FIG. 4 with a pushed on sleeve.

For contacting the strands 70 the sleeve 32 is pushed over the strand support element 30, preferably during a subsequent step as is clear from FIG. 5, whereby the hook elements 46 are pivoted in the direction of inserted strands 70, so that the strands 70 are clamped between the hook elements 46 and the interior wall 48 of the strand support element 30 by the hook elements 46. This is clear from the cross-sectional illustration of FIG. 5 shown in FIG. 6. The hook elements 46 hook into the insulation 74 of the strands 70 with their wedge shaped surface and prevent the strands 70 being axially displaced along their longitudinal axis in this way.

Figure 7:
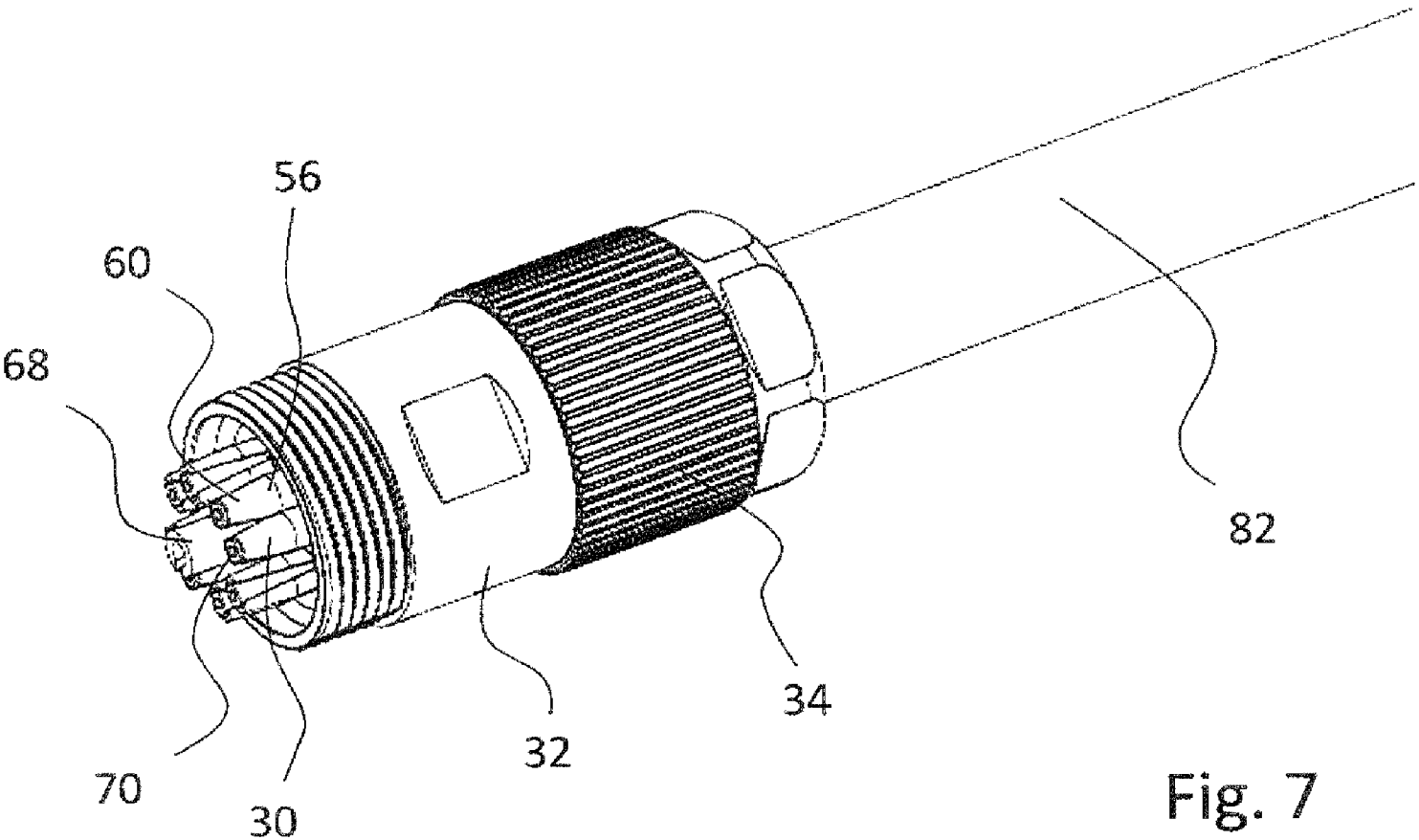
FIG. 7 a schematic illustration of the strand support element shown in FIG. 5 with a pushed on sleeve, whereby the inserted strands have been shortened to the appropriate length.

Once the strands 70 have been secured against axial displacement by means of the hook elements 46 the strands 70 are preferably cut off along the facing side of the conically shaped end section 60, so that all strands 70 are of the same length, as is clear from FIG. 7. Prior to cutting the strands 70 it is of advantage if the nut 34 can be screwed on, so that a strain relief can be provided for the cable 82. Once the strands 70 have been cut off the individual strands 70 can be contacted with the contact elements 14.

FIG. 8 shows a mating pattern of an assembled plug part 10, which has been positioned for contacting the pre-assembled cable uptake 12 as shown in FIG. 7. It is clear here that two contact elements 14 each are preferably arranged parallel to each other, whereby each pair of contact elements 14 is shielded against the other by a shield element 76 in the form of a shield plate. The arrangement of the contact elements 14 here equals the arrangement of the strands 70 in the cable uptake 12 to be able to realise a simple and quick contacting by plugging the plug part 10 into the cable uptake 12.

Figure 9:
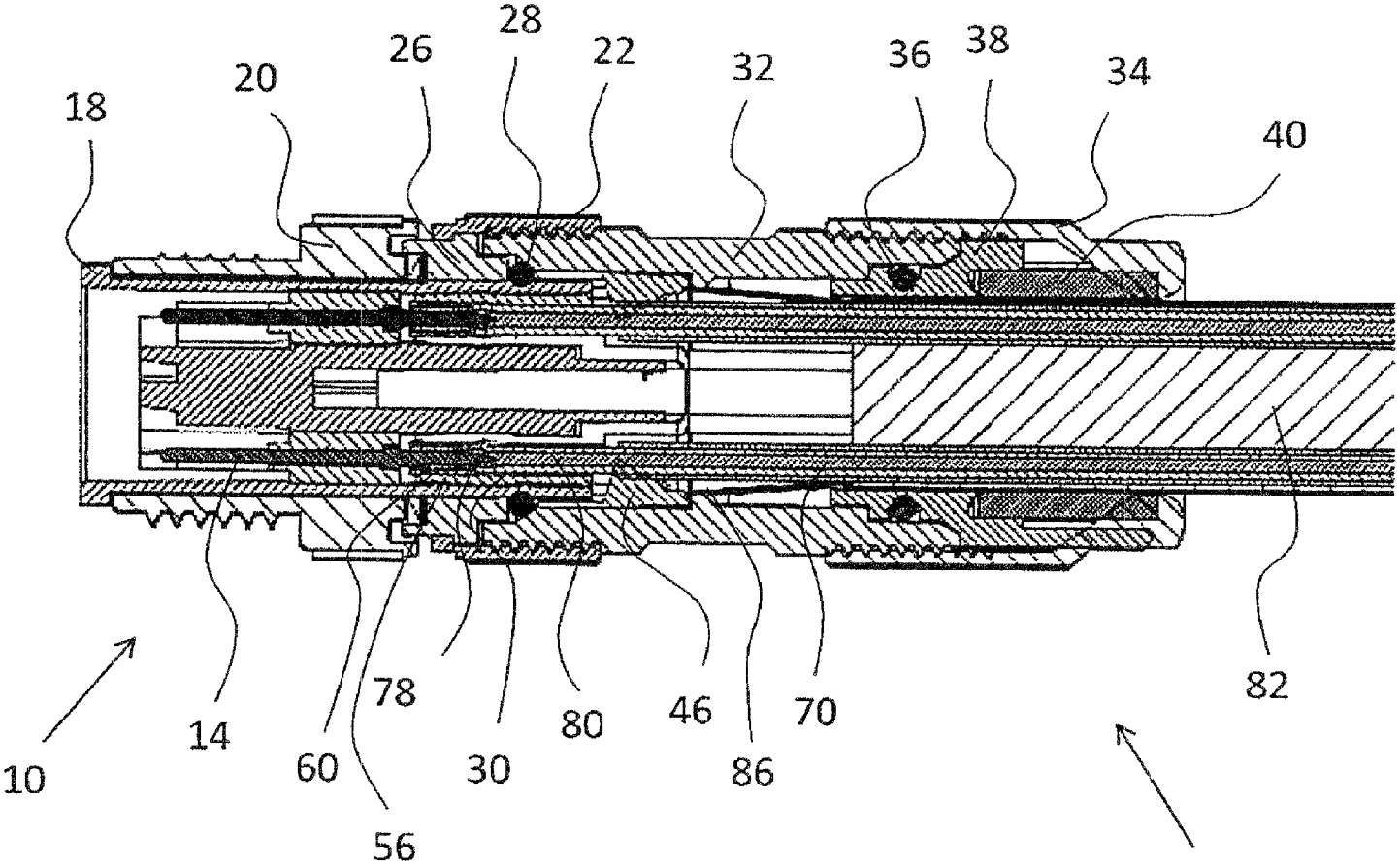
FIG. 9 a schematic cross-sectional illustration of a cable connector according to the invention, whereby the plug part is connected with the cable uptake.

FIG. 9 shows an assembled cable plug, where the plug part 10 is connected with the cable uptake 12, whereby the contact elements 14 contact the strands 70 in an axial direction in that the contact elements 14 are pressed into the cores 80 of the strands 70 in an axial direction with their bar-shaped end section 78, so that a piercing of the strands 70 results. Contacting the individual strands 70 with the respective contact elements 14 is preferably realised simultaneously by joining the plug part 10 with the cable uptake 12. The guide elements 56 are pressed onto the respective strands 70 in a radial direction in the area of the conically shaped end section 60 of the guide elements 56, so that a particularly secure contacting can be achieved. The conically shaped end sections 60 are supported in the preferably elliptically formed openings 84 in the interior space of the sleeve as shown in FIG. 8, and thus enables the application of a greater radial spring force onto the contact point where contacting between the strands 70 and the contact elements 14 takes place, and an improved centering of the strands 70 or the cores 80 of the strands 70 towards the bar-shaped end section 78 of the contact point 14 during contacting.

The cable connector of the invention can for example be designed as an Ethernet cable with a PIMF shield, where the strands 70 can be shielded in pairs by the casing 72 designed as a metal foil. In the assembled cable connector the casing 72 of individual strands 70 arranged as pairs can be inserted in the area of the strand supper element 30 where the hook elements 46 are formed, as is shown in FIG. 4, so that an overlap with the shield elements 76 of the plug part 10 is envisaged in the assembled condition. In this way crosstalk between the strands 70 adjacently located as pairs can be minimised.

LIST OF REFERENCE NUMBERS

Plug part 10
Cable uptake 12
Contact element 14
Contact support element 16
Sleeve 18
Screw element 20
Knurl 22
Spring 24
Clamping ring 26
Sealing element 28
Strand support element 30
Sleeve 32
Nut 34
Sealing element 36
Crown 38
Sealing sleeve 40
Annular surface 42
Base plate element 44
Hook element 46
Interior wall 48
Surface 50
Abutment surface 52
Insertion direction 54
Guide element 56
Through bore 58
End section 60
End section 62
Slit-shaped opening 64
Groove-shaped opening 66
Encoding dome 68
Strand 70
Casing 72
Insulation 74
Shield element 76
Bar-shaped end section 78
Core 80
Stranded cable 82
Opening 84
Shielded braid 86

The invention claimed is:

1. A cable connector for connecting a multi-core stranded cable, the cable connector comprising:

a plug part comprising a plurality of contact elements formed as contact bars, and a cable uptake comprising a strand support element for receiving strands of the multi-core stranded cable, wherein the strand support element comprises a plurality of pivotally mounted hook elements, which clamp and affix the strands introduced into the strand support element between the hook elements pivoted towards the strands and an interior wall of the strand support element through a pivot movement in an assembled condition of the connector.

2. The cable connector according to claim 1, wherein the plurality of hook elements are designed such that two strands are clamped and affixed simultaneously through one hook element.

3. The cable connector according to claim 1, wherein the plurality of hook elements are wedge shaped.

4. The cable connector according to claim 1, wherein the strand support element comprises a plurality of guide elements for guiding the strands along an internal circumferential surface of the guide elements, and wherein the internal circumferential surface of the guide elements is pressed against the external diameter of the strands inserted into the strand support element.

5. The cable connector according to claim 4, wherein the plurality of guide elements are designed such that the plurality of guide elements apply a radial spring force to the strands in the area of a contact point, in which the plurality of contact elements are inserted into the strands in a contacting condition.

6. The cable connector according to claim 4, wherein the plurality of guide elements each comprise a slit-shaped opening along a longitudinal surface thereof.

7. The cable connector according to claim 6, wherein the plurality of guide elements each comprise a conical end section.

8. The cable connector according to claim 4, wherein the strand support element comprises an annular surface and a plurality of base plate elements formed on the annular surface, and wherein the plurality of hook elements are provided on the annular surface and the plurality of guide elements are provided on the base plate elements.

9. The cable connector according to claim 8, wherein two of the plurality of guide elements are provided on one of the plurality of base plate elements.

10. The cable connector according to claim 8, wherein a groove-shaped opening is provided between two of the plurality of base plate elements for receiving a shield element.

11. The cable connector according to claim 1, wherein said connector comprises a multipolar cable connector.

* * * * *